United States Patent [19]

Wünsch

[11] 4,364,281

[45] Dec. 21, 1982

[54] DRIVING MECHANISM FOR TOOL SLIDES OF PUNCHING AND BENDING MACHINES

[76] Inventor: Adolf Wünsch, Haus Nr. 210, D-8959 Seeg-Ried, Fed. Rep. of Germany

[21] Appl. No.: 173,849

[22] Filed: Jul. 30, 1980

[30] Foreign Application Priority Data

Aug. 1, 1979 [DE] Fed. Rep. of Germany ..... 2931195

[51] Int. Cl.[3] ..... F16H 25/14; F16H 53/06

[52] U.S. Cl. ..... 74/55; 74/569

[58] Field of Search ..... 74/55, 567, 569; 83/602, 628

[56] References Cited

U.S. PATENT DOCUMENTS

| | | | |
|---|---|---|---|
| 324,784 | 8/1885 | Pinkham | 74/55 |
| 1,227,812 | 5/1917 | MacPherson | 74/55 |
| 2,343,208 | 2/1944 | Scott | 74/509 |
| 2,503,521 | 4/1950 | Stover | 74/55 |
| 2,962,904 | 12/1960 | Soccart | 74/55 |
| 3,017,779 | 1/1962 | Beals | 83/628 |
| 3,151,501 | 10/1964 | Hicks | 74/569 |
| 4,085,634 | 4/1978 | Sattler | 74/569 |

FOREIGN PATENT DOCUMENTS

| | | | |
|---|---|---|---|
| 429658 | 9/1911 | France | 74/55 |
| 852382 | 1/1940 | France | 74/569 |

*Primary Examiner*—Lawrence J. Staab

*Attorney, Agent, or Firm*—Offner and Kuhn

[57] ABSTRACT

In a punching and bending machine the driving mechanism 10 for a reciprocating a tool slide 50 comprises a pair of cam plate and push rod arrangements 20, 38 and 22, 58 one for the working stroke and the other for the return stroke. They move in an oil filling contained in a hermetically sealed housing 28. The contacting ends of the push rods 38, 58 are provided with carbide tippings 46, 60 and the peripheral surfaces of the cam plates 20, 22 are hardened or nickel-plated. The driving mechanism can be used in high speed machines making at least 2000 strokes per minute.

4 Claims, 2 Drawing Figures

DRIVING MECHANISM FOR TOOL SLIDES OF PUNCHING AND BENDING MACHINES

Figure 1:
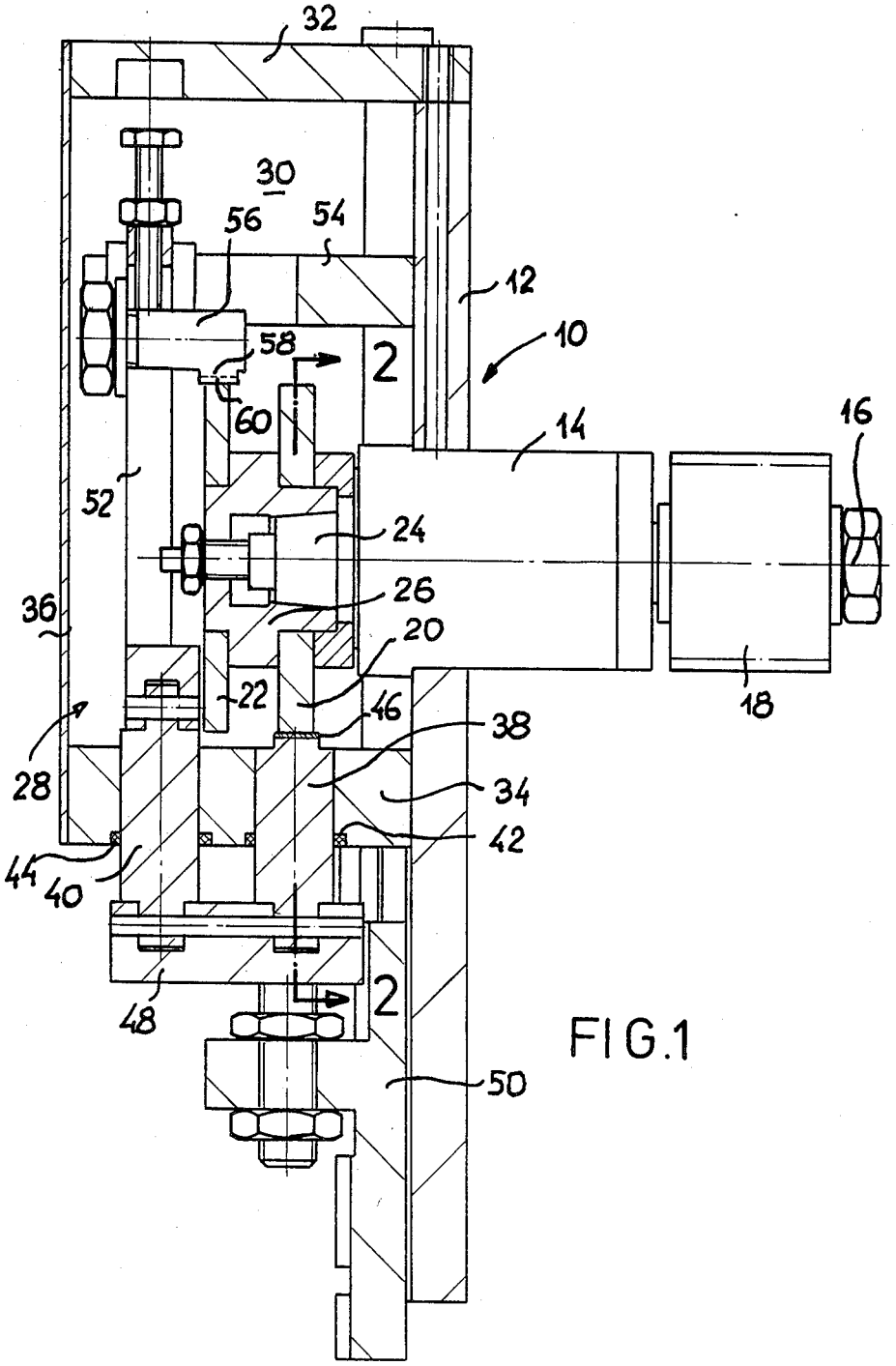

The present invention relates to a driving mechanism for tool slides of automatic punching and bending machines comprising a frame, a shaft rotatably supported on the frame, a driving pinion fixed on one end of the shaft, for engagement with a central wheel of a bending unit, a cam plate fixed on the opposite end of the shaft, connecting means contacting the circumference of the cam plate and connected with a tool slide for a reciprocating motion.

According to the state of art the connecting means consists of a small idle pully rotatably supported on a shaft fixed on the tool slide. Such driving mechanisms have been used in the past in large numbers and operate satisfactory in slow-speed punching and bending machines. However when the operating speed is increased wear at the idlepully will occur already after a short time. The result is that the punching and bending operations not longer can be precisely performed and when handling precise work pieces waste will be produced.

Therefore one object of the invention is to improve the driving mechanism of the afore mentioned type so that it can be used in connection with high-speed punching and bending machines. One further object is to provide a new driving mechanism which allows a higher stroke number per minute without any troubles and for a long lifetime. Last not least it is an object of the invention to provide for a driving mechanism which can co-operate even with cam plates having narrow concave circumferential portions.

According to the invention in the driving mechanism as described above the connecting means is formed as a push rod provided with a convex end face as seen in axial direction of the shaft the convex endface being provided with a carbide tipping, the driving mechanism further comprises a housing fastened at the frame, the housing being hermetically sealed and filled with oil, the cam plate being arranged within the housing, a wall of the housing provided with a bore, sealing means within the bore, and the push rod extending through the bore into the housing.

The invention gains the advantage that the punching and bending machine can be operated with a much higher speed up to 2000 strokes per minute and even more, avoiding any wear or troubles during a long operating time. The oil filling provides for a continuous oil film between the cam plate and the push rod avoiding any seizures. In contrast to the state of art between the cam plate and the push rod no rolling motion but a pure sliding motion takes place. Nevertheless due to the oil film between the sliding parts any wear can be avoided which is in contrast to known constructions using idle pullies on the tool slides. This surprising effect can be explained by that the idle pullies must have a relatively small diameter because there are cam plates having concave circumferential portions into which the pullies must fit. The pullies therefore are rotated with a much higher speed than the cam plates. Further because of the shapes of the cam plates alternating accelerations and decelerations occur which are responsible for sliding and grinding motions instead of pure rolling motions between the cam plate and the idle pully. Because of this dry sliding friction the known driving mechanism would have only a short life time when operated with high-speed machines.

The present invention avoids these disadvantages.

Further embodiments of the invention consist in that the running surface of the cam plate is nickel-plated or carbide-plated, and in that an additional cam plate push rod arrangement for the return motion of the tool slide is provided in the housing, the cam plate of which being fastened on the shaft and the pair of push rods being 180 degrees offset to one another with respect to the driving shaft, and in that the push rod for the return motion is adjustably fastened on a tie rod which is parallel with the push rod having the carbide tipping and sealingly protrudes through the same wall of the housing, the push rod and the tie rod being fixed at a common part of the tool slide.

The invention avoids any return springs because the tool slide return motion is positively controlled by the return stroke cam plate and push rod arrangement. Both of that cam plate and push rod arrangements are provided within the hermetically sealed housing containing the oil filling. Due to that the machine can be operated with high speeds in the region of 2000 revolutions per minute.

Figure 2:
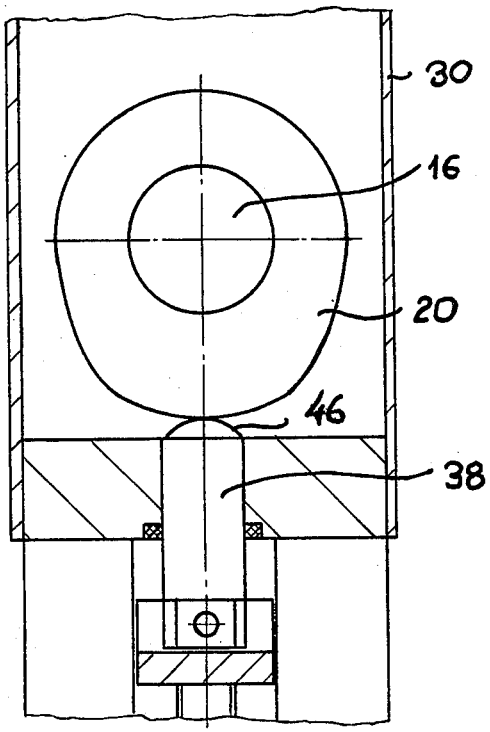

Further features and advantages can be gained from the following description of an example of the new driving mechanism with reference to the accompanying drawings, in which FIG. 1 shows a longitudinal section view of the new driving mechanism; and FIG. 2 shows a cross-section view taken along line 2—2 of FIG. 1.

The drawings show a driving mechanism 10 which has a frame plate 12 in which a bearing 14 for a shaft 16 is provided. A pinion 18 is fastened on one end of the shaft 16 and a first cam plate 20 and spaced therefrom a second cam plate 22 are fastened on the opposite side of the shaft. The shaft 16 has a conical portion 24 on which a fastening body 26 is clamped in such a manner that the first cam plate 20 can be continuously adjusted in relation to the second cam plate in peripheral direction.

A hermetically sealed housing 28 is fastened at the frame 12 and is composed of side walls 30, a back wall 32, a front wall 34, and an upper wall 36 opposed to the frame 12. The hermetically closed housing 28 contains an oil filling.

The front wall 34 of the housing 28 has a pair of bores in each of which a push rod 38 and a slide member 40 are supported respectively for reciprocating motions. Push rod and sliding member are sealed against the housing by sealing rings 42, 44. The push rod 38 has a cylindrical convex peripheral face on the front side of which, i.e. in the axial cross-section of FIG. 1 containing the axis of the shaft 16; the peripheral face of the front end forms a straight line while in the radial cross-section of FIG. 2 this peripheral face is convexedly curved. The push rod is provided with a carbide tipping 46 at its front end peripheral face. The push rod 38 is held in contact with the circumference of the cam plate 20 by means of a return motion arrangement which will be described later. Linear contact exists between cam plate 20 and push rod 38.

The push rod 38 and the slide member 40, both of equal cross-section, are connected with one another by a connecting member 48 outside of the housing 28. The connecting member 48 is adjustably connected with a tool slide 50 carrying the bending tool (not shown).

The slide member 40 passing through the packing ring 44 and the front wall 34 is connected with a tie rod 52 which is linearly movable in opposite directions and guided for this reciprocating motion in a strut 54 of the housing. A bolt 56 extending rectangularly to the tie rod is fastened at the tie rod and can be adjusted in the longitudinal direction of which. A push rod 58 in form of a projection of the bolt has a carbide tipping 60 as the first push rod 38 and its front end is of cylindrical convex shape as the front end of the first push rod 38. The push rod projection 58 is in contact with the second cam plate 22. The contact lines between cam plate 20 and push rod 38 in one case and between cam plate 22 and push rod projection 58 in the other case are oppositely situated, i.e. they are situated in the cross-section plane of FIG. 1 containing the axis of the shaft 16.

In the position of FIG. 2 the cam plate 20 and the push rod 38 have displaced the tool slide 50 into the end position of which. When the rotation of the shaft 16 is continued the push rod projection 58 runs on a peripheral portion of increasing diameter of the cam plate 22 and draws back the tool slide into the opposite end position of which by means of the tie rod 52, the slide member 40, and the connecting member 48. Due to the fact that both of the cam plate push rod arrangements 20, 38 and 22, 58 run in the oil filling a high speed drive is possible without troubles. The peripheral surfaces of the cam plates 20, 22 are hardened or are nickel-plated or carbide-plated in order to provide for a long lifetime.

I claim:

1. An improved driving mechanism for reciprocating tool slides of automatic punching and bending machines comprising:

(a) a hermetically sealed, oil-filled housing, fastened on a frame;

(b) a driving shaft sealingly extending through and journalled in a wall of the housing, (c) a pair of cam plates fixed on the driving shaft within the housing, the cams thereof being in 180° offset position with respect to one another;

(d) a push rod sealingly extending through a bore provided in a second wall of the housing;

(e) a tie rod arrangement arranged in parallel relationship with the push rod within the housing and comprising a slide member and a tie rod connected therewith, the slide member sealingly extending through a second bore provided in said second wall of the housing;

(f) the push rod and the slide member being fastened to a tool slide slidably quided on the frame outside of the housing;

(g) the tie rod extending beyond the axis of the driving shaft;

(h) a cam follower adjustably fastened at the tie rod;

(i) the inner end of the push rod provided with a convex end face; and (j) each of the cam follower of the tie rod arrangement and the push rod being held in contact with different cam plates.

2. A driving mechanism as claimed in claims 1, wherein the convex face end of the push rod is hardened.

3. A driving mechanism as claimed in claims 1, wherein the convex face end of the push rod is nickel-plated.

4. A driving mechanism as claimed in claims 1, wherein the convex face end of the push rod is carbide-plated.

* * * * *